US005180047A

United States Patent [19]

Barrett et al.

[11] Patent Number: 5,180,047

[45] Date of Patent: Jan. 19, 1993

[54] BALUSTRADE AND DECK MOUNTING ASSEMBLY FOR ESCALATOR OR MOVING WALKWAY

[75] Inventors: Dale R. Barrett, Berlin; Dat Nguyen, New Britain; Frank M. Sansevero, Glastonbury, all of Conn.

[73] Assignee: Otis Elevator Company, Farmington, Conn.

[21] Appl. No.: 864,755

[22] Filed: Apr. 7, 1992

[51] Int. Cl.[5] ..... B66B 23/22

[52] U.S. Cl. ..... 198/335

[58] Field of Search ..... 198/335, 333

[56] References Cited

U.S. PATENT DOCUMENTS

| | | | |
|---|---|---|---|
| 3,926,296 | 12/1975 | Woodling et al. | 198/16 R |
| 3,991,877 | 11/1976 | Kraft et al. | 198/335 |
| 4,159,758 | 7/1979 | Courson | 198/335 |
| 4,646,907 | 6/1987 | Streibig et al. | 198/335 |
| 4,690,264 | 9/1987 | Adrian et al. | 198/335 |
| 4,819,781 | 4/1989 | Saito et al. | 198/335 |
| 4,842,122 | 6/1989 | Van Nort | 198/335 |
| 5,029,690 | 7/1991 | Nguyen et al. | 198/335 |

FOREIGN PATENT DOCUMENTS

| | | | |
|---|---|---|---|
| 2941773 | 4/1981 | Fed. Rep. of Germany | 198/335 |
| 1512084 | 2/1968 | France | 198/335 |

*Primary Examiner*—D. Glenn Dayoan

[57] ABSTRACT

The balustrade and decks of an escalator or moving walkway are mounted on a conveyor truss via a plurality of anchor brackets which are welded to the truss at spaced apart locations thereon. Template brackets are secured to each anchor bracket to define the location of the outer deck, the inner top shirt panel, the balustrade clamps, and the return path handrail guides. Skirt jack bolt mounts are mounted on the anchor brackets below the return path of the handrail and are operable to provide for proper positioning of the inner side skirt panels relative to the steps. The handrail can be easily released from its return guides and removed from the interior of the decking by removing the inner top skirt panel. The assembly can be easily erected in the field and readily serviced.

4 Claims, 1 Drawing Sheet

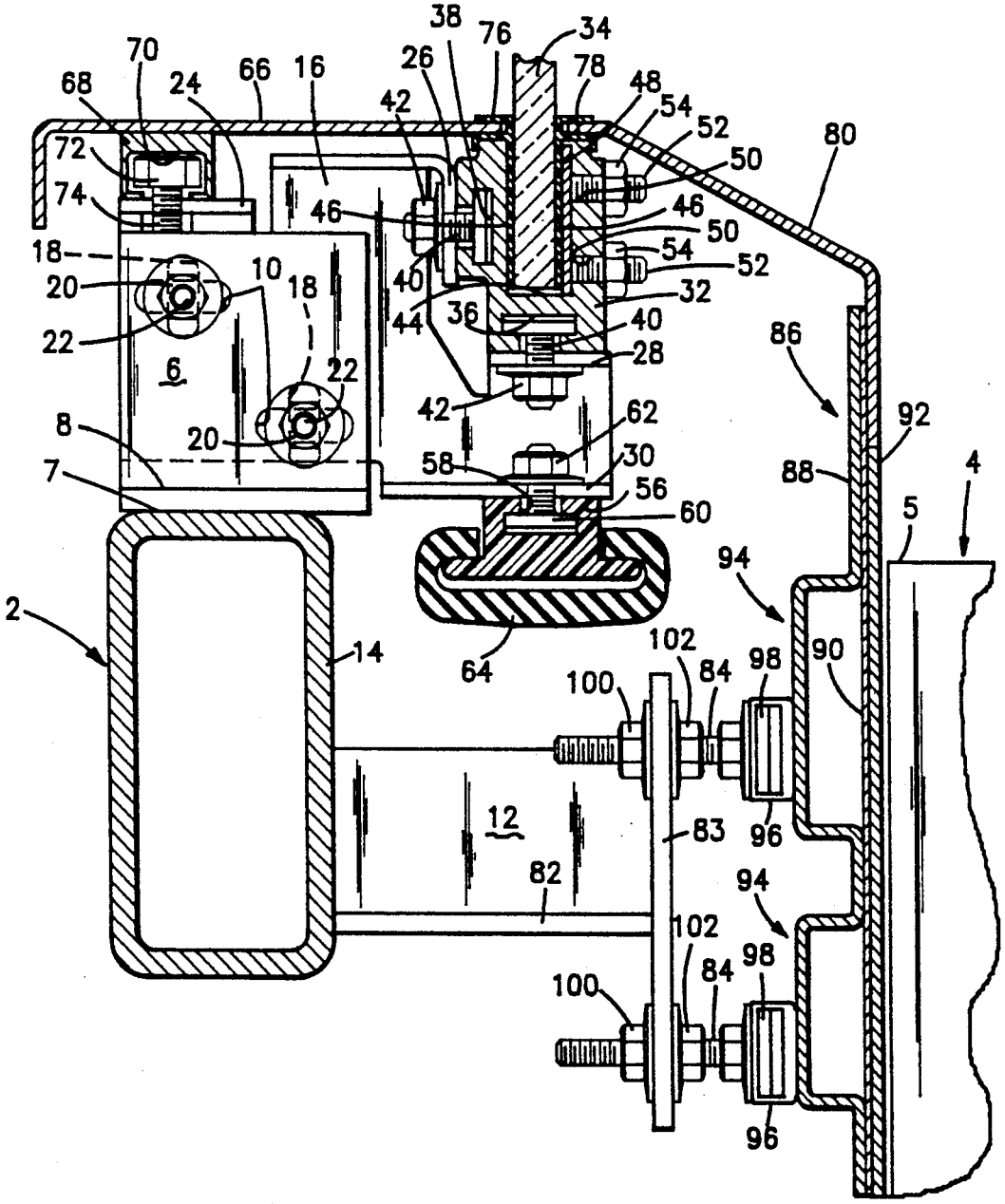
38
76
34
70
26
78
68
24
66
16
48
42
54
52
80
72
50
74
46
46
50
18
54
10
52
20
18
40
32
44
36
40
22
28
86
6
22
42
62
92
8
20
58
30
88
4
7
56
5
60
94
2
14
64
102
90
100
84
98
12
83
96
82
94
102
98
84
100
96

BALUSTRADE AND DECK MOUNTING ASSEMBLY FOR ESCALATOR OR MOVING WALKWAY

TECHNICAL FIELD

This invention relates to an improved mounting assembly for the balustrade and the inner and outer deck panels on an escalator or moving walkway. More particularly, the improved mounting assembly of this invention ensures ready access to the return path of the handrail for servicing, installation and handrail replacement and repair.

BACKGROUND ART

Modern streamlined escalators and moving walkways are provided with slim balustrades formed from a sheet material, usually glass. The glass balustrades are held in place by mounting assemblies which are disposed beneath the side decks of the escalator or the like. These mounting assemblies will typically include some sort of channel member in which the bottom of the balustrade rests. The balustrade will be secured to the channel or channels with drilled through nut-bolt assemblies, or with adhesives, or with some sort of clamping device. The channel can be a relatively long extruded metal member, or it can be made up of a number of short separate clamps which are spaced along the bottom edge of the balustrade. The balustrade-supporting channel or channels will be somehow tied into the truss of the structure, and also provides the anchoring points for the inner and outer decks which flank the steps or treads on the escalator or the like. Finally, the handrail return guides which guide movement of the handrails along their return path of travel have also been anchored to the balustrade-supporting channel or channels.

The mounting systems of the prior art have two drawbacks which relate to the location of the handrail, and the accessibility of the various mounting components for installation, servicing, repair and the like from outside of the decks. It will be appreciated that the mounting systems are buried beneath the decks, and accessibility for servicemen is of paramount importance. U.S. Pat. Nos. 3,926,296 granted Dec. 16, 1975 to G.L. Woodling et al; 3,991,877 granted Nov. 16, 1976 to J.K. Kraft, et al; 4,646,907 granted Mar. 3, 1987 to K. Streibig, et al; 4,690,264 granted Sep. 1, 1987 to W. Adrian, et al; and 4,819,781 granted Apr. 11, 1989 to C. Saito, et al. are all illustrative of prior art glass balustrade and deck mounting systems of the type described above. It will be noted that in each of the aforesaid patented systems, all of them except that disclosed in U.S. Pat. No. 4,690,264 to Adrian, et al. include physical obstructions between the inner side skirts of the escalator and the return run of the handrail. This requires extensive disassembly of the system before the handrail can be reached to be serviced. If one were to desire to remove and replace a worn handrail, the entire inner skirt assemblies and their inner supporting brackets have to be removed because each of these support brackets blocks removal of the handrail from its return path of travel. The Adrian, et al. U.S. Pat. No. 4,690,264 discloses a mounting assembly which does not block access to the handrail, but wherein the handrail is positioned quite deeply under the decks, and is difficult to reach even in the absence of physical impediments. A much more desirable location for the handrail return path is approximately even with the step treads, as is shown in the Saito, et al. U.S. Pat. No. 4,819,781, but, as previously noted, the skirt fastenings block access to the handrail even though it is elevated. It would be highly desirable to provide a mounting assembly of the type described above wherein the handrail return run is located at about the same level as the step treads, and close to the upper inner skirt panel, while being free of obstructions, so that the handrail can be easily reached, and can be removed from its return guide system without having to dismantle the entire inner skirt structure.

DISCLOSURE OF THE INVENTION

This invention relates to an escalator or the like balustrade, skirt panel and handrail mount assembly which provides improved skirt support, solid balustrade support, and positions the handrail return path up high at the level of the step treads of the escalator. The assembly is fastened to the escalator truss, and can be easily and quickly assembled, serviced and repaired in the field since the mounting components are all positioned in close proximity with the inner and outer upper decks. The connections with the truss for the handrail and balustrade are made by anchor brackets which are welded to the truss at spaced apart locations therealong outboard of the location of the balustrade. The inner skirt panels are also secured to the truss through the use of anchor brackets welded to the truss at locations outboard of the location of the balustrade. The mounts which connect the handrail guides and the balustrade support channel with the anchor brackets are template brackets that are adjustably bolted to the anchor brackets and that include bolting flanges which provide sites for automatically locating and fastening the handrail guides and the balustrade channel in place. The balustrade support channel and the handrail return guides, as well as the outer deck fastenings are all mounted on the template brackets. The inner side deck skirts which flank the steps are mounted on anchor brackets which are disposed below the return path of travel of the handrail. The upper step skirt panels are mounted in a plastic gasket which is carried in the balustrade support channel. This latter panel can be easily removed to provide open access to the balustrade support channel, the handrail, and sets of jack bolts which position and secure the inner side deck skirts in place.

It is therefore an object of this invention to provide a mounting assembly for an escalator or the like balustrade and associated deck, skirt and handrail return guide components.

It is a further object of this invention to provide a mounting assembly of the character described which includes an inner top deck which can be easily removed to expose the mounting components for service, repair and replacement.

It is an additional object of this invention to provide a mounting assembly of the character described wherein the handrail return guides are disposed at substantially the same level as the step treads on the escalator or the like.

It is yet another object of this invention to provide a mounting assembly of the character described wherein the skirt panels are connected to the escalator truss by brackets which are disposed below the handrail return path whereby clear access is had to the handrail return path throughout the entire rise or length of the escalator or the like.

BRIEF DESCRIPTION OF THE DRAWING

These and other objects and advantages of the invention will become more readily apparent from the following detailed description of a preferred embodiment thereof when taken in conjunction with the accompanying drawing which is a fragmented sectional view of the mounting assembly of the invention.

BEST MODE FOR CARRYING OUT THE INVENTION

Referring to the drawing, the escalator or moving walkway includes a supporting truss, a portion of which is designated by the numeral 2, on which all of the components of the escalator are mounted. The escalator steps are shown schematically at 4. It will be understood that the truss component 2 extends for the length of the escalator and is generally parallel, or equispaced from the path of travel of the steps 4. The truss component 2 is thus a beginning reference basis for the locations of the remaining components of the escalator. A plurality of first anchor brackets 6 are welded to the top surface 7 of the truss component 2 at spaced apart points along the length of the latter. The brackets 6 are generally L-shaped and include a basal flange 8 which serves as the weld site. The brackets 6 are provided with a pair of laterally elongated holes 10. A plurality of second anchor brackets 12 are also welded to the inner side surface 14 of the truss component 2 at spaced apart locations, and extend toward the steps 4.

Each of the anchor brackets 6 has a template bracket 16 bolted thereto. The template brackets 16 are provided with vertically elongated holes 18 which are matched with the holes 10 on the anchor brackets 6. Nuts and bolts 20, 22 are used to secure the two brackets 6 and 16 after proper positioning is achieved. The template brackets 16 are provided with four flanges 24, 26, 28 and 30 which define proper anchoring sites for several of the escalator structural components. The flanges 26 and 28 serve as anchoring sites for the balustrade support channel 32. The support channel 32 is preferably an extruded aluminum member, which in a typical escalator assembly will be about thirteen feet long in the incline, and which provides full support for the glass balustrade panels 34. The channel 32 is formed with a lower T-shaped slot 36 and an outer side T-shaped slot 38. Bolts 40 and lock nuts 42 are operable to fasten the support channel 32 to the template bracket flanges 26 and 28 thereby providing bi-directional stability to the support channel 32. An upwardly open slot 44 is formed in the support channel 32 for reception of the balustrade 34. Plastic liners 46 are positioned in the slot 44 on either side of the balustrade 34 to provide increased frictional gripping of the balustrade panels 34. A metal clamping plate 48 is disposed inside of the slot 44 and sandwiched between the liner 46 and the side wall of the support channel 32 which faces the steps 4. Threaded bores 50 are formed in the side of the support channel 32 adjacent the clamping plate 48, and set screws 52 are threaded into the bores 50 against the clamping plate 48 to tighten the latter against the liner 46 and balustrade 34. Lock nuts 54 are used to secure the set screws 52 in place.

Handrail guide pieces 56 are mounted on the template bracket flanges 30. The guide pieces 56 are formed from extruded high density polyethylene, and are each about five inches or so long. Thus, each of the template brackets 16 will support its own individual handrail guide 56. The guide is formed with a T-shaped slot 58 which faces the flange 30, and in which a bolt 60 is positioned. Lock nuts 62 are used to fasten the guide 56 to the flange 30. The guide 56 is itself generally T-shaped so as to telescopingly receive the handrail 64.

The template flange 24 is used to locate and support the outer top deck panel 66. A support piece 68 underlies and is connected to the deck panel 66. The piece 68 is formed with a T-shaped slot 70 which receives a bolt 72. A nut 74 secures the bolt 72, the piece 68 and the panel 66 to the flange 24. The end of the panel 66 nearest the balustrade 34 is nested in a pocket 76 in the outer of the two liners 46. The inner of the liners 48 also is formed with a pocket 78 which receives the edge of an inner top skirt panel 80.

The second anchor bracket 12 is also L-shaped and includes a lower flange 82. A plate 83 is welded to the inner end of the bracket 12 and serves to support a pair of adjustable jack bolts 84. The inner deck skirt 86 is made up of three panels 88, 90 and 92 which are laminated together. The outermost of the three panels 88 is formed with ribs 94 to which are secured C-shaped clips 96. The clips 96 receive the headed ends 98 of the jack bolts 84. The plate 83 serves as a fixed bed for adjustment nuts 100, 102 threaded onto the jack bolts 84 on either side of the plate 83. By properly positioning the nuts 100 and 102 on the jack bolts 84, the deck skirt 86 can be moved toward or away from the steps 4. The skirt 86 is thus properly positioned with the jack bolts 84 to produce an acceptable gap between the skirt 86 and the side of the steps 4. Once the skirt 86 is properly in position, the nuts 100 and 102 will be used to lock the jack bolts 84 to the plate 83. It will be noted that the inner top skirt panel 80 overlaps the medial panel 90 and abuts the innermost panel 92 to form a continuation thereof.

It will be readily appreciated that the assembly can be erected in the field when new equipment is being installed, and that all of the anchoring sites on the brackets are readily accessible with the panels 66 and 80 removed. When new equipment is being erected in the field, the panels 66 and 80 will be the last elements of all those shown in the drawing to be secured in place. It will be noted that the area beneath the skirt panel 80 is completely free of obstructions so that the jack bolts 84, set screws 50 and 52 and the handrail 64 can be easily reached by a service person once the panel 80 is removed. There is very little chance of injuring one's hands working in this area, and full maneuverability of wrenches or other tools is easily achieved. The open area beneath the panel 80 and the elevation of the handrail guides 56 permits the handrail 64 to be slipped off of the guides 56 and pulled out of the skirt interior through the gap left by removal of the panel 80.

Since many changes and variations of the disclosed embodiment of the invention may be made without departing from the inventive concept, it is not intended to limit the invention otherwise than as required by the appended claims.

What is claimed is:

1. A balustrade and deck mounting assembly for escalators or moving walkways, said assembly comprising:

a) a plurality of first anchor brackets secured to a truss member on the escalator or moving walkway outboard of the escalator or moving walkway steps;

b) a template bracket mounted on each of said anchor brackets, said template brackets being positionally adjustable relative to said anchor brackets for ensuring proper location of each element mounted on said template brackets;

c) a balustrade support channel mounted on said template brackets for receiving the lower edge portion of a glass balustrade;

d) an inner deck panel connected to said balustrade support channel, said deck panel depending from said support channel toward said steps;

e) an outer deck panel connected to said support channel, said outer deck panel extending away from said steps, and said outer deck panel being secured to each of said template brackets;

f) handrail return guide means mounted on said template brackets for guiding return movement of a handrail, said handrail return guide means being positioned at approximately the same level as tread portions of said steps;

g) a plurality of second anchor brackets secured to said truss member at locations below said handrail return guide means, said second anchor brackets extending toward said steps;

h) a skirt panel assembly positioned adjacent to said steps and said inner deck panel;

i) adjustable mounting means connected to said second anchor brackets and to said skirt panel assembly for positioning and holding said skirt panel assembly in a properly spaced relationship with respect to said steps; and j) removal of said inner deck panel from the mounting assembly providing clear unimpeded access to said balustrade support channel, said handrail and handrail return guide means, and said adjustable mounting means whereby installation, service and repair of the handrail, balustrade support channel and adjustable mounting means is facilitated.

2. The mounting assembly of claim 1 wherein removal of said inner deck panel from said balustrade support channel allows withdrawal of said handrail from said handrail guide means without disconnecting said skirt panel assembly from said adjustable mounting means.

3. The mounting assembly of claim 1 wherein a bottom surface and an outer side surface of said balustrade support channel are connected to mutually perpendicular flanges on said template brackets.

4. The mounting assembly of claim 1 wherein said adjustable mounting means are connected to said skirt panel assembly at points below the level of said tread portions of said steps.

* * * * *